US010239587B1

(12) United States Patent
Corman

(10) Patent No.: US 10,239,587 B1
(45) Date of Patent: Mar. 26, 2019

(54) BUOY STORAGE SYSTEM

(71) Applicant: Joseph Corman, Centerville, IN (US)

(72) Inventor: Joseph Corman, Centerville, IN (US)

( * ) Notice: Subject to any disclaimer, the term of this patent is extended or adjusted under 35 U.S.C. 154(b) by 0 days.

(21) Appl. No.: 15/849,747

(22) Filed: Dec. 21, 2017

(51) Int. Cl.
*B63B 25/28* (2006.01)
*B63B 59/02* (2006.01)
*B63B 22/00* (2006.01)

(52) U.S. Cl.
CPC ..... *B63B 25/28* (2013.01); *B63B 59/02* (2013.01); *B63B 22/00* (2013.01)

(58) Field of Classification Search
CPC ..... B63B 25/28; B63B 22/00; B63B 59/02
USPC ..... 114/364
See application file for complete search history.

(56) References Cited

U.S. PATENT DOCUMENTS 4,290,529 A * 9/1981 Jones ..... B63B 59/02 211/60.1
4,526,124 A * 7/1985 Hartwall ..... B63B 59/02 114/219
4,773,348 A * 9/1988 Rowley ..... B63B 59/02 114/219
4,823,724 A 4/1989 Lumpkin
5,074,506 A * 12/1991 Larsen ..... B63B 17/00 248/284.1
5,474,273 A * 12/1995 Vinal ..... A47C 7/68 248/126
D422,390 S * 4/2000 Chipman ..... D34/6
D469,449 S 1/2003 Andrews
8,534,212 B1 * 9/2013 Worsley ..... B63B 59/02 114/219
2003/0226489 A1 * 12/2003 Carter ..... B63B 7/06 114/257
2006/0159524 A1 * 7/2006 Thompson ..... B63C 11/00 405/190

* cited by examiner

*Primary Examiner* — Lars A Olson
*Assistant Examiner* — Jovon E Hayes

(57) ABSTRACT

A buoy storage system for storing buoys on a boat includes a plurality of buoys that is each employed on a boat. A plurality of baskets is provided and each of the baskets is mounted on a deck of the boat such that each of the baskets is accessible to a user. Each of the buoys is removably positioned in an associated one of the baskets for storage and each of the buoys is vertically oriented in the associated basket.

7 Claims, 5 Drawing Sheets

BUOY STORAGE SYSTEM

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to storage devices and more particularly pertains to a new storage device for storing buoys on a boat.

BRIEF SUMMARY OF THE INVENTION

An embodiment of the disclosure meets the needs presented above by generally comprising a plurality of buoys that is each employed on a boat. A plurality of baskets is provided and each of the baskets is mounted on a deck of the boat such that each of the baskets is accessible to a user. Each of the buoys is removably positioned in an associated one of the baskets for storage and each of the buoys is vertically oriented in the associated basket.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
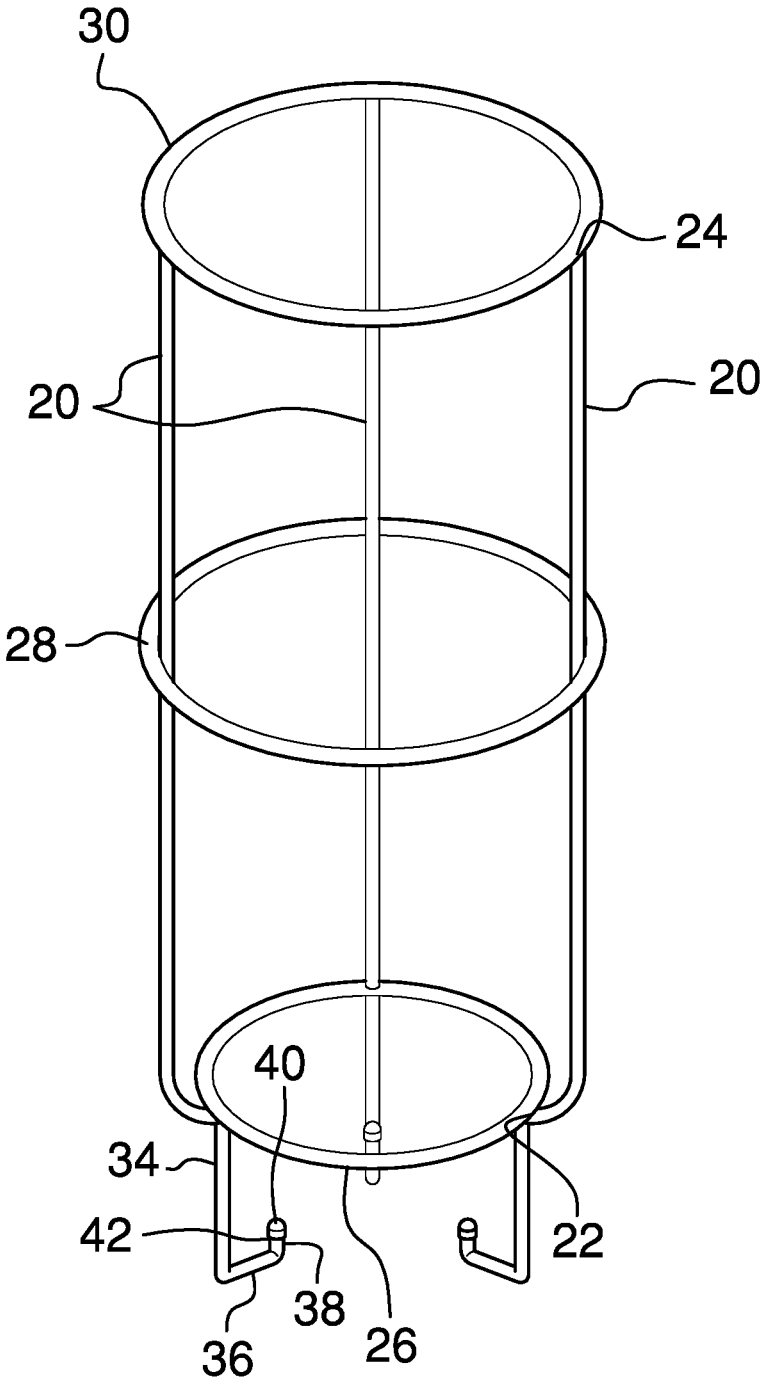
FIG. 1 is a perspective view of a basket of buoy storage system according to an embodiment of the disclosure.
Figure 2:
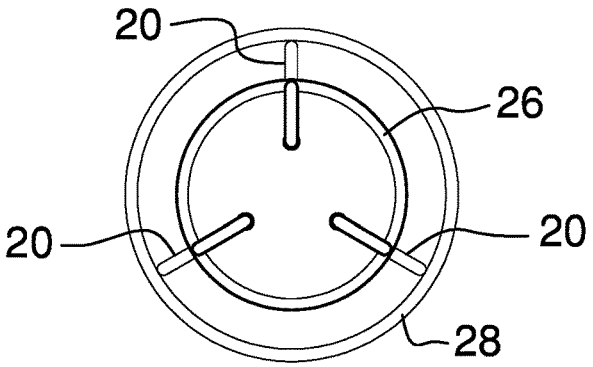
FIG. 2 is a bottom view of a basket an embodiment of the disclosure.
Figure 3:
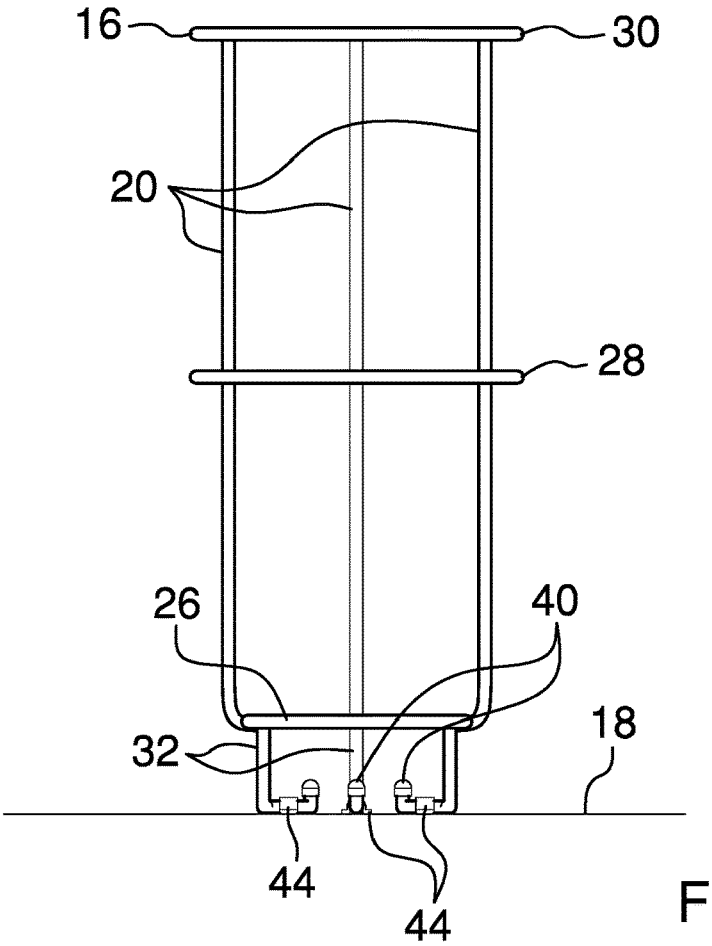
FIG. 3 is a front view of a basket an embodiment of the disclosure.
Figure 4:
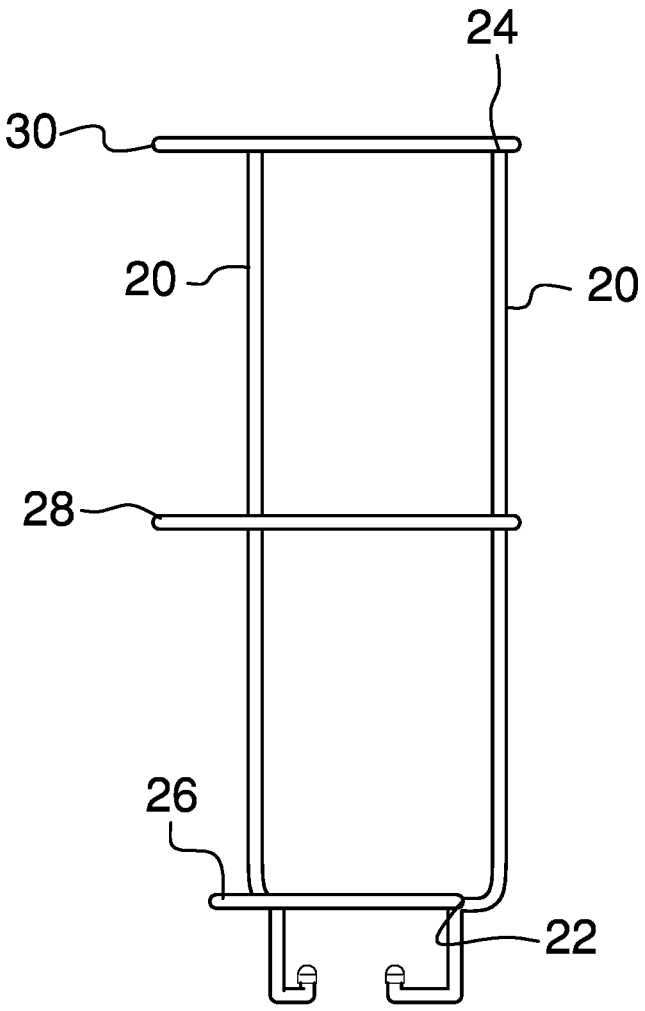
FIG. 4 is a left side view of a basket of an embodiment of the disclosure.
Figure 5:
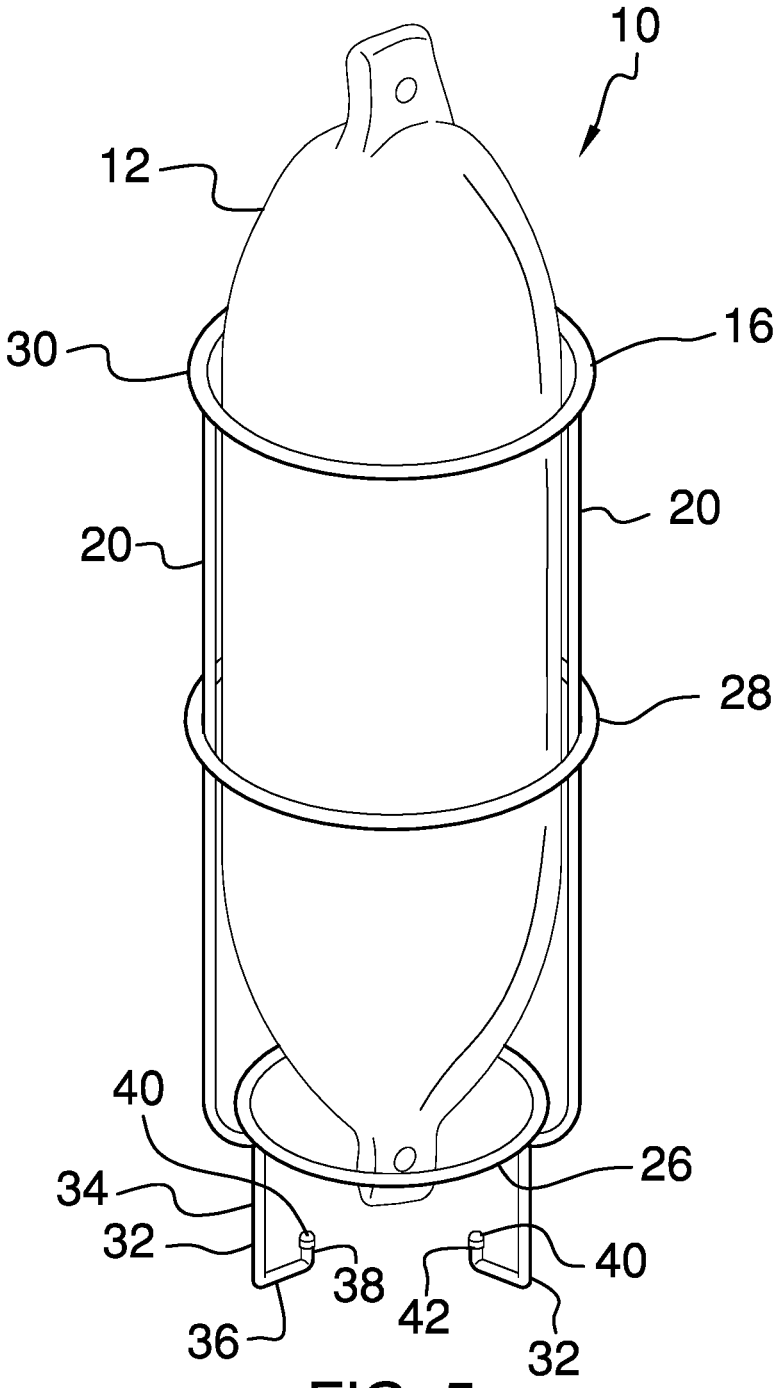
FIG. 5 is a perspective view of an embodiment of the disclosure.
Figure 6:
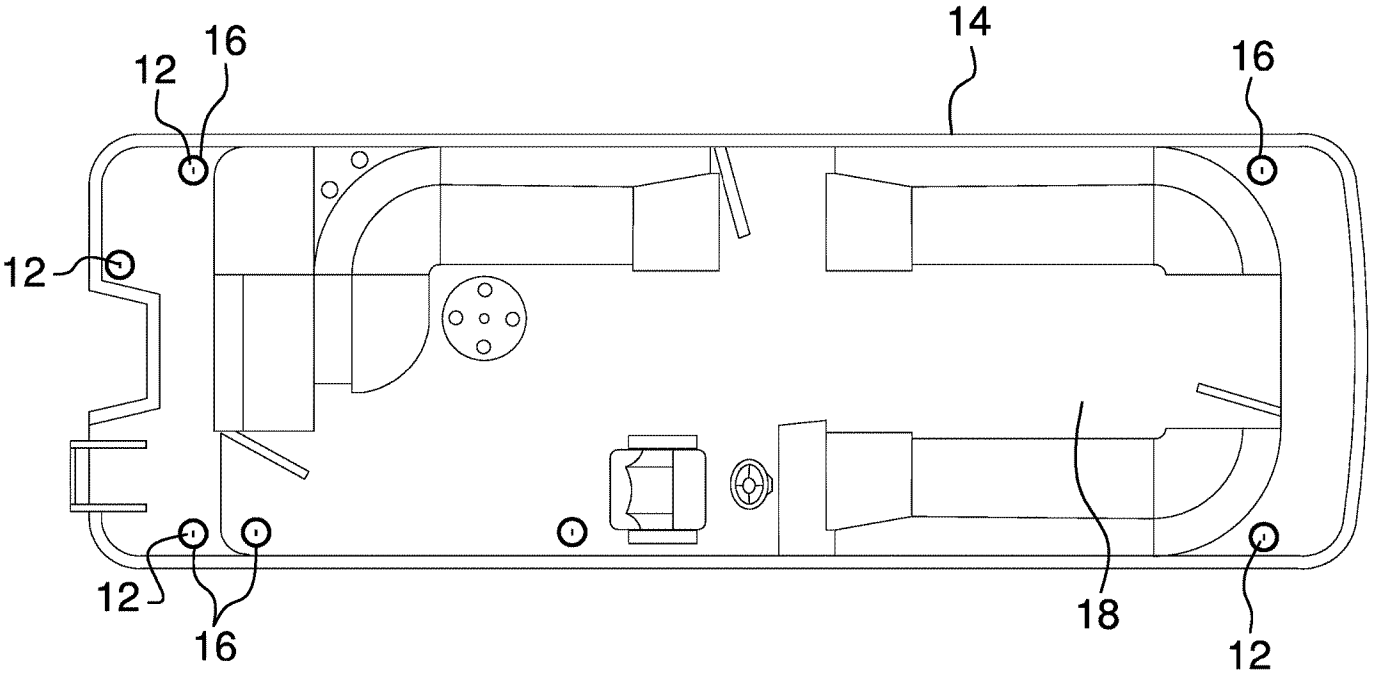
FIG. 6 is a perspective in-use view of an embodiment of the disclosure.

With reference now to the drawings, and in particular to FIGS. 1 through 6 thereof, a new storage device embodying the principles and concepts of an embodiment of the disclosure and generally designated by the reference numeral 10 will be described.

As best illustrated in FIGS. 1 through 6, the buoy storage system 10 generally comprises a plurality of buoys 12 that is each employed on a boat 14. The boat 14 may be a pontoon boat and any other type of boat. The buoys 12 may be flotation buoys, dock cushions and any other conventional type of buoys commonly employed on boats.

A plurality of baskets 16 is provided and each of the baskets 16 is mounted on a deck 18 of the boat 14. Additionally, each of the baskets 16 is positioned in dead space, such as inside corners or the like, on the boat 14. Thus, the baskets 16 are accessible to a user while minimizing loss of walking area on the deck 18. Each of the buoys 12 is removably positioned in an associated one of the baskets 16 for storage.

Each of the baskets 16 comprises a plurality of uprights 20 and each of the uprights 20 has a first end 22 and a second end 24. Each of the uprights 20 may have a length ranging between approximately 30.0 cm and 90.0 cm. A first ring 26 is provided and the first end 22 of each of the uprights 20 is coupled to the first ring 26. Each of the uprights 20 extends upwardly from the first ring 26 and the second end 24 of each of the uprights 20 is spaced from the first ring 26. Moreover, the uprights 20 are spaced apart from each other and are distributed around the first ring 26.

A second ring 28 is coupled to each of the uprights 20 such that the second ring 28 extends around each of the uprights 20. The second ring 28 is spaced from and is aligned with the first ring 26. A third ring 30 is coupled to the second end 24 of each of the uprights 20 such that the third ring 30 is spaced from and is aligned with the second ring 28. The first ring 26 has a diameter that is less than a diameter of each of the second ring 28 and the third ring 30. Additionally, each of the uprights 20 may curve inwardly adjacent to the first ring 26 such that each of the uprights 20 extends laterally toward the first ring 26. A selected one of the buoys 12 is extended through the third ring 30 and the second ring 28 such that the selected buoy rests on the first ring 26. Thus, the selected buoy is retained in a vertical orientation in the basket 16.

A plurality of feet 32 is provided and each of the feet 32 is coupled to and extends downwardly from the first ring 26. Each of the feet 32 has a first section 34 that extends downwardly from the ring. Additionally, each of the feet 32 has a second section 36 extending laterally away from the first section 34. The second section 36 corresponding to each of the feet 32 abuts the deck 18 on the boat 14. Each of the feet 32 has a third section 38 extending upwardly from the second section 36 and the third section 38 is spaced from the first section 34.

A plurality of caps 40 is provided and each of the caps 40 is attached to a terminal end 42 of an associated one of the feet 32. Thus, the caps 40 inhibit the terminal end 42 of each of the feet 32 from presenting sharp edges. A plurality of fasteners 44 is provided and each of the fasteners 44 engages an associated one of the feet 32 and the deck 18 of the boat 14. Thus, the fasteners 44 retain the basket on the deck 18. The fasteners engage the second section 36 of the associated foot 32 and the fasteners 44 may be clips, nails and any other type of penetrating fastener.

In use, the baskets 16 are positioned at selected locations on the deck 18 of the boat 14 and the fasteners 44 are employed to fasten each of the baskets 16 to the deck 18. The buoys 12 are positioned in selected ones of the baskets 16 for storage. The buoys 12 are selectively removed from the baskets 16 for deploying. Thus, the buoys 12 are retrieved from storage without disturbing passengers on the boat 14 resulting from storing the buoys 12 in conventional storage areas.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A buoy storage system comprising:

a plurality of buoys, each of said buoys being configured to be employed on a boat;

a plurality of baskets, each of said baskets being configured to be mounted on a deck of the boat such that each of said baskets is accessible to a user, each of said buoys being removably positioned in an associated one of said baskets for storage, each of said buoys being vertically oriented in said associated basket, each of said baskets comprises a plurality of uprights, each of said uprights having a first end and a second end;

a first ring, said first end of each of said uprights being coupled to said first ring such that each of said uprights extends upwardly from said first ring having said second end of each of said uprights being spaced from said first ring, said uprights being spaced apart from each other and being distributed around said first ring; and a plurality of feet, each of said feet being coupled to and extending downwardly from said first ring wherein each of said feet is configured to abut the deck of the boat.

2. The assembly according to claim 1, further comprising a second ring being coupled to each of said uprights such that said second ring extends around each of said uprights, said second ring being spaced from and being aligned with said first ring.

3. The assembly according to claim 2, further comprising a third ring being coupled to said second end of each of said uprights such that said third ring is spaced from and is aligned with said second ring.

4. A buoy storage system comprising:

a plurality of buoys, each of said buoys being configured to be employed on a boat;

a plurality of baskets, each of said baskets being configured to be mounted on a deck of the boat such that each of said baskets is accessible to a user, each of said buoys being removably positioned in an associated one of said baskets for storage, each of said buoys being vertically oriented in said associated basket, each of said baskets comprises a plurality of uprights, each of said uprights having a first end and a second end;

a first ring, said first end of each of said uprights being coupled to said first ring such that each of said uprights extends upwardly from said first ring having said second end of each of said uprights being spaced from said first ring, said uprights being spaced apart from each other and being distributed around said first ring;

a second ring being coupled to each of said uprights such that said second ring extends around each of said uprights, said second ring being spaced from and being aligned with said first ring;

a third ring being coupled to said second end of each of said uprights such that said third ring is spaced from and is aligned with said second ring; and wherein said first ring has a diameter being less than a diameter of each of said second ring and said third ring, a selected one of said buoys being extended through said third ring and said second ring such that said selected buoy rests on said first ring having said selected buoy being retained in a vertical orientation.

5. The assembly according to claim 1, wherein each of said feet has a first section extending downwardly from said ring, each of said feet having a second section extending laterally away from said first section wherein said second section corresponding to each of said feet is configured to abut the deck on the boat, each of said feet having a third section extending upwardly from said second section, said third section being spaced from said first section.

6. The assembly according to claim 5, further comprising a plurality of fasteners, each of said fasteners engaging an associated one of said feet wherein each of said fasteners is configured to attach said associated foot to the deck of the boat.

7. A buoy storage system comprising:

a plurality of buoys, each of said buoys being configured to be employed on a boat;

a plurality of baskets, each of said baskets being configured to be mounted on a deck of the boat such that each of said baskets is accessible to a user, each of said buoys being removably positioned in an associated one of said baskets for storage, each of said buoys being vertically oriented in said associated basket, each of said baskets comprising:

a plurality of uprights, each of said uprights having a first end and a second end;

a first ring, said first end of each of said uprights being coupled to said first ring such that each of said uprights extends upwardly from said first ring having said second end of each of said uprights being spaced from said first ring, said uprights being spaced apart from each other and being distributed around said first ring;

a second ring being coupled to each of said uprights such that said second ring extends around each of said uprights, said second ring being spaced from and being aligned with said first ring;

a third ring being coupled to said second end of each of said uprights such that said third ring is spaced from and is aligned with said second ring, said first ring having a diameter being less than a diameter of each of said second ring and said third ring, a selected one of said buoys being extended through said third ring and said second ring such that said selected buoy rests on said first ring having said selected buoy being retained in a vertical orientation; and a plurality of feet, each of said feet being coupled to and extending downwardly from said first ring, each of said feet having a first section extending downwardly from said ring, each of said feet having a second section extending laterally away from said first section wherein said second section corresponding to each of said feet is configured to abut the deck on the boat, each of said feet having a third section extending upwardly from said second section, said third section being spaced from said first section; and a plurality of fasteners, each of said fasteners engaging an associated one of said feet wherein each of said fasteners is configured to attach said associated foot to the deck of the boat.

* * * * *